US005211504A

United States Patent [19]

Trudel

[11] Patent Number: 5,211,504

[45] Date of Patent: May 18, 1993

[54] ADJUSTABLE MANHOLE TOP

[76] Inventor: Roger Trudel, 218 John Street, Sudbury, Ontario, P3E 1P6, Canada

[21] Appl. No.: 648,743

[22] Filed: Jan. 31, 1991

[51] Int. Cl.[5] ..... E02D 29/14

[52] U.S. Cl. ..... 404/26

[58] Field of Search ..... 404/25-26

[56] References Cited

U.S. PATENT DOCUMENTS

| | | | |
|---|---|---|---|
| 638,692 | 12/1899 | Banwell | 404/26 |
| 3,228,943 | 11/1965 | Bowman | 404/26 |
| 3,263,580 | 8/1966 | MacMillan | 404/25 |
| 3,629,981 | 12/1971 | McCaffery | 404/26 |
| 3,773,428 | 11/1973 | Bowman | 404/26 |
| 3,930,739 | 1/1976 | Larsson et al. | 404/26 |
| 4,075,796 | 2/1978 | Cuozzo | 404/26 |
| 4,187,647 | 2/1980 | Hall | 404/26 |
| 4,281,944 | 8/1981 | Bowman | 404/26 |
| 4,512,492 | 4/1985 | Graybeal | 404/25 |
| 4,906,128 | 3/1990 | Trudel | 404/26 |

*Primary Examiner*—Ramon S. Britts
*Assistant Examiner*—Nancy P. Connolly
*Attorney, Agent, or Firm*—Burke-Robertson

[57] ABSTRACT

An adjustable manhole top which can be readily raised up or down in minutes to correct problems when the ground around it heaves. A cylindrical sleeve with a plurality of spaced elongated ribs extending longitudinally along an internal surface thereof, is adjustably seated by its ribs resting in notches at predetermined elevations on riser blocks upwardly extending from height adjustment rings resting on the support rim.

10 Claims, 2 Drawing Sheets

ADJUSTABLE MANHOLE TOP

BACKGROUND OF THE INVENTION

The present invention relates to an adjustable manhole top, and more particularly to a manhole top which can be raised up or down to correct problems caused when ground around the manhole heaves.

The ground about a manhole may heave, for example during winter conditions of consecutive frosts and thaws. This may make it very difficult for example for snowplows, the blades of which may then catch an upwardly projecting edge of the manhole cover or manhole cover support.

Conventional manholes have a foundation of circular cross-sectional shape, which may be of poured concrete. Above this foundation, and supported thereon, are bricks which in turn support a manhole cover plate having a manhole cover supporting rim. Asphalt or cement for the roadway is generally laid on or about the manhole cover plate. When the ground level about a manhole changes for whatever reason, for example from frost heaves or erosion of the ground about the manhole, repair work so that the manhole cover is again level with the surface of the roadway may require significant labour, including ripping up of the roadway surface and removal of the manhole cover plate and bricks, down to the concrete foundation. Thus, there is a need for a manhole top which can be easily adjusted, in a vertical direction, to take into account periodic changes in the level of the surrounding roadway.

Adjustable manhole tops are known. For example Canadian Patent No. 1,081,020 describes and illustrates a construction of manhole top in which screw bolts are passed through the manhole cover to bear against a support for raising or lowering the cover. Canadian Patent No. 1,161,263 describes and illustrates slip rings which go under the cover and its support to permit it being incrementally raised. Canadian Patent No. 68,905 describes and illustrates a construction in which the bottom of the manhole cover is provided with saw teeth on an incline to interact with corresponding saw teeth on an incline on a base support, to permit, upon relative rotation of the cover and base, the raising or lowering of the cover. Canadian Patent No. 1,068,961 features screw bolts which extend upwardly from the base to bear against the underside of the manhole cover to permit its raising or lowering. Such constructions possess many inherent difficulties, such as that of corrosion and seizing of the adjustment mechanisms or the need to rip up the roadway about the manhole top to activate the adjustment mechanism.

U.S. Pat. No. 2,254,668 of Tomek issued Sep. 2, 1941 describes and illustrates an upwardly and downwardly adjustable sleeve on which the manhole cover is supported. The sleeve telescopically fits on a cylindrical support base. The adjustable sleeve is levelled, to provide a proper manhole cover level, embedding a flange or the like which outwardly extends from the outer surface of the sleeve in the roadway surface while the sleeve is supported at a proper height. Again, this proposed construction faces many of the same problems of conventional manhole tops. The heaving of the roadway, for example, will result in breaking of the roadway about the manhole sleeve as a result of the flange embedded therein. This will require additional resurfacing of the roadway about the manhole sleeve. As well, the sleeve over time will tend to corrode and become seized in position on the cylindrical support base, making it extremely difficult to adjust.

Thus, it is an object of the present invention to provide a vertically adjustable manhole top which is designed to be easily vertically adjustable, with minimum need for excavation or resurfacing prior to, during or after adjustment. It is a further object of the present invention to provide such an adjustable manhole top which allows the passage of water, sand and the like through it, into the manhole, without clogging up the top. It is a further object of the present invention to provide such an adjustable manhole top in which corrosion does not significantly impede the adjustment operation.

SUMMARY OF THE INVENTION

In accordance with the present invention there is provided an adjustable manhole top comprising a cylindrical sleeve having an internal, manhole cover-supporting rim towards one end. A plurality of spaced elongated ribs extend longitudinally along an internal surface of the sleeve below the rim. The top also has a support rim comprising a planar base to be rested on the upper edge of a manhole foundation and a cylindrical wall extending upwardly from the base. An annular portion of the base extends inwardly, beyond the inner surface of the wall for supporting the sleeve. The wall is of a diameter so as to co-operate with the sleeve to prevent relative lateral displacement thereof. An annular height adjustment ring is provided to sit on and be supported by the inwardly extending annular portion of the base. Riser blocks are secured to and upwardly extend from the height adjustment ring, the riser blocks each having an upper surface with steps thereon at a plurality of pre-determined elevations. The blocks and steps are positioned so as to supportably receive the lower ends of corresponding ribs of the sleeve at the same one of said predetermined elevations. The cylindrical sleeve and the height adjustment ring are relatively rotatable so as to permit alignment of the ribs and the steps for supporting of the sleeve and the manhole cover at a predetermined elevation.

In a preferred embodiment, the steps are in the form of notches located at progressively higher elevations with respect to the height adjustment ring, across the upper surface of each of the riser blocks. As well, it is preferred that a total of four spacer blocks be positioned on the height adjustment ring, the blocks spaced about the ring at 90° angles from each other. Correspondingly, a total of four ribs are positioned on the inner wall of the sleeve, each rib spaced at a 90° angle from ribs adjacent thereto.

The manhole cover and sleeve according to the present invention can be raised or lowered with respect to the support rim so that the manhole cover remains flush with the surface of the roadway, simply and in little time. Excavation of the roadbed around the manhole top would not normally be required to carry out such adjustment. Moreover, because of the construction of the manhole top in accordance with the present invention, corrosive seizing of the relatively movable parts of the manhole top in accordance with the present invention is minimized.

BRIEF DESCRIPTION OF THE DRAWINGS

These and other objects and advantages of the invention will become apparent upon reading the following detailed description and upon referring to the drawings in which.

Figure 1:
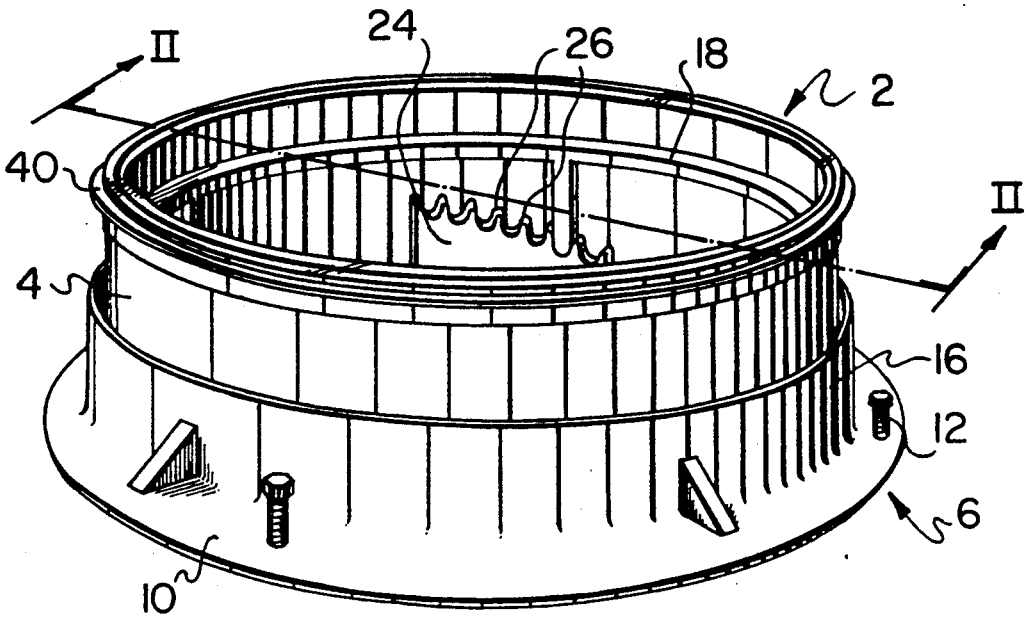
FIG. 1 is a perspective view of a manhole top in accordance with the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
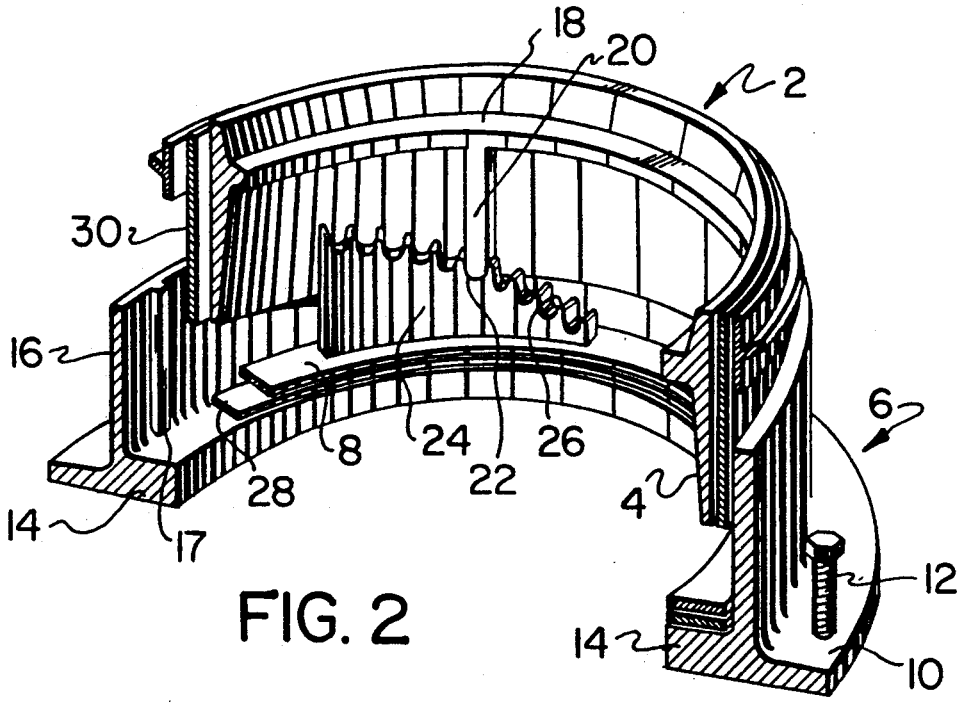
FIG. 2 is a section view along II—II of FIG. 1.
Figure 3:
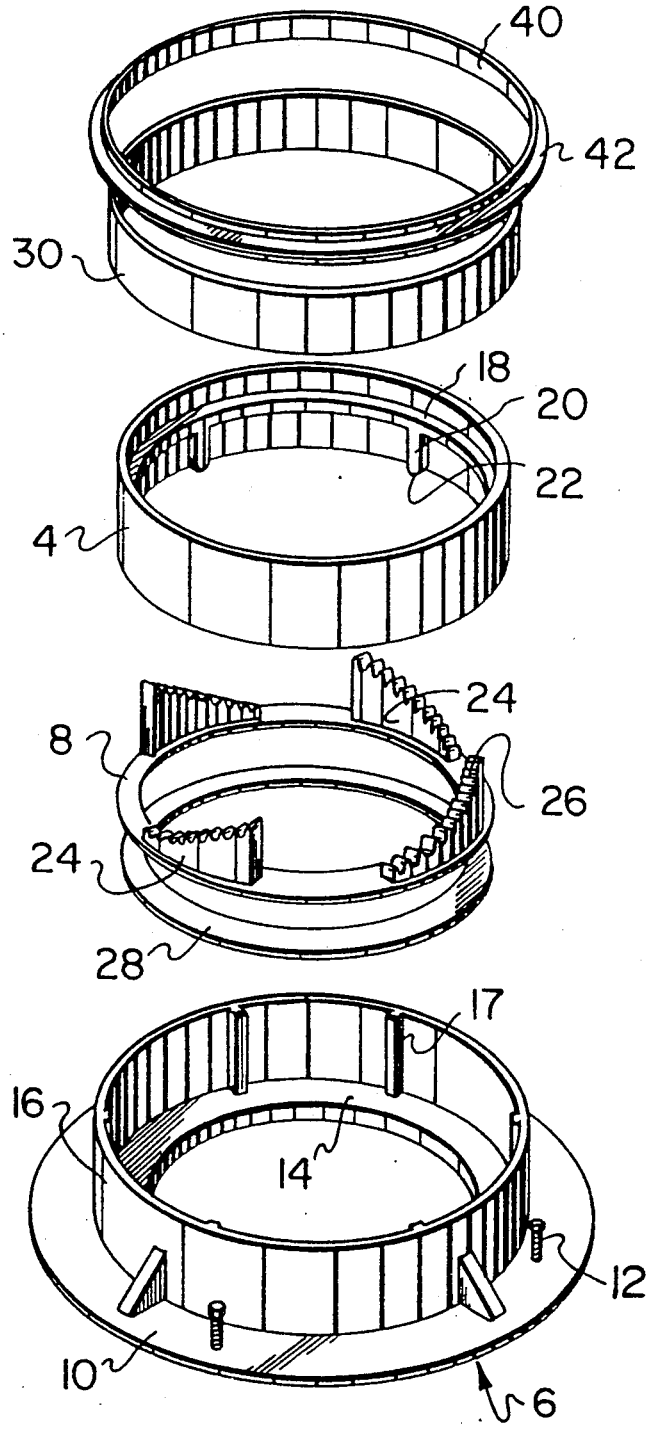
FIG. 3 is an exploded perspective view of the manhole top of FIG. 1, illustrating its various components.

Turning to FIGS. 1 and 2 there is illustrated an adjustable manhole top 2 in accordance with the present invention comprising a vertically adjustable cylindrical sleeve 4, a support rim 6 and an annular height adjustment ring 8 (FIG. 2). Support rim 6 has an annular base 10 which is seated on the upper edge of a poured concrete manhole foundation of poured concrete or the like (not illustrated) by initial grade adjustment bolts 12. Turning of these adjustment bolts will adjust the initial height of manhole top 2 so that it may be brought up to road grade height. An annular portion 14 of base 10 extends inwardly as illustrated (FIG. 2) so as to provide a support for height adjustment ring 8 and cylindrical sleeve 4. Also integral with base 10 is a cylindrical, upstanding wall 16 which circumscribes sleeve 4 when in position as illustrated, and is of a diameter to prevent relative lateral displacement of sleeve 4 with respect to support rim 6. Axially extending ribs 17 may optionally be spaced about the inner surface of wall 16, as illustrated, to provide if required a drainage space when sleeve 4 is in position and minimize the chance of sleeve 4 seizing in position within wall 16.

On the interior surface of sleeve 4 is positioned, near its top, a manhole cover supporting rim 18. A plurality of spaced elongated ribs 20 extend below that rim longitudinally, in a direction parallel to the axis of the cylindrical sleeve, along that interior surface. These elongated ribs 20 are preferably equally spaced 90° abut sleeve 4. Each rib 20 preferably has a convexly curved lower end 22.

For each of the ribs 20 is a corresponding riser block 24 secured to and upwardly extending from the upper surface of height adjustment ring 8. The upper surface of each riser block 24 is provided with a series of steps 26, the steps located at progressively higher elevations across the surface. The steps are in the form of concavely shaped notches, as illustrated, so as to mateably receive ends 22 of ribs 20.

In the illustrated embodiment four riser blocks 24 are equally spaced 90° about height adjustment ring 8. The riser blocks 24 and their notched steps 26 are positioned so as to enable all of the ribs 20 of sleeve 4 to be simultaneously mateably received in notches of the same elevation with respect to the height adjustment ring. By relative rotative adjustment of sleeve 4 with respect to ring 8, these ribs can be simultaneously mateably received in notches at a different elevation, thereby permitting easy adjustment of the height of a manhole cover supported on rim 18 of sleeve 4.

When in position, height adjustment ring 8 is supported on inner extending annular portion 14 of base 10. Sleeve 4, by way of ribs 20, is supported on steps of a predetermined elevation on riser blocks 24. This construction ensures that sleeve 4 will remain rigidly in position on rim 6 as downward pressure is applied to the top of sleeve 4.

It is preferred that a polyethylene ring 28 sit on annular portion 14 to provide a non-corrosive (e.g. polyethylene) liner between base 10 of support rim 6 and height adjustment ring 8 and thereby facilitate relative movement of ring 8 when required. As well, a non-corrosive (e.g. polyethylene) liner 30 provides a non-corrosive liner between sleeve 4 and wall section 16.

To change the relative elevation of sleeve 4, and hence a manhole cover seated on rim 18, a worker need only lift sleeve 4, with respect to support rim 6, and rotate that sleeve relative to height adjustment ring 8 and riser blocks 24, in the desired direction, so that a series of notched steps 26 of lower or higher elevation are aligned with ends 22 of ribs 20. Sleeve 4 is then lowered so that ends 22 of ribs 20 are seated in those notched steps. (Of course, this same result may be achieved by relatively rotating ring 8 with respect to sleeve 4, after sleeve 4 has been lifted with respect thereto. Non-corrosive ring 28 and liner 30 further facilitate the adjustment of the relative height of sleeve 4 with respect to support rim 6, by reducing the chance of height adjustment ring 8 and riser blocks 24 seizing onto support rim 6 and sleeve 4 seizing onto the wall 16. As well, liner 30 reduces the chance of roadway payment or asphalt sticking to sleeve 4 as its elevation is adjusted.

In a preferred form of the invention, a retainer collar 40 is snugly fitted about the upper end of sleeve 4, so that the upper edge of sleeve 4 and the upper edge of collar 40 are approximately flush. When cement is poured or asphalt is laid about a manhole incorporating a top 2 including such a collar 40, outer annular projection 42 of collar 40 becomes embedded in the cement or asphalt, to secure the collar in position. If the roadway surface subsequently lifts or heaves, for example as a result of frost, the collar will lift with it and the edge of the cement or asphalt surface about the collar will not break or deteriorate as traffic runs over the edge of that surface and collar.

To further facilitate the adjustment of the relative height of sleeve 4 with respect to the base of rim 6, the outer surface of sleeve 4 may be covered with a coating or sleeve (not illustrated) of non-corrosive material such as a plastic. This will also reduce the chance of the roadway pavement or asphalt sticking to sleeve 4 as its elevation is adjusted.

In operation, pavement is laid flush with the upper edge of collar 40 and sleeve 4, when sleeve 4 has been positioned with respect to base 10 of support rim 6, at an appropriate elevation.

As previously indicated, the sleeve of the manhole top 2 of the present invention can be raised or lowered in minutes to correct the problems caused when the ground around it shifts, for example as a result of heaving or erosion. As well, the brick work needed to support the conventional manhole support plates is not required with this invention, thereby providing a more secure and long lasting construction.

Thus it is apparent that there has been provided in accordance with the invention an adjustable manhole top that fully satisfies the objects, aims and advantages set forth above. While the invention has been described in conjunction with a specific embodiment/specific embodiments thereof, it is evident that many alternatives, modifications and variations will be apparent to those skilled in the art in light of the foregoing description. For example, a similar construction, but in square or rectangular transverse cross-sectional shape, would be used for roadway catch basins. Accordingly, it is intended to embrace all such alternatives, modifications and variations as fall within the spirit and broad scope of the invention.

What is claimed is:

1. An adjustable manhole top comprising:

(a) a cylindrical sleeve having an internal, manhole cover-supporting rim towards one end, a plurality of spaced elongated ribs extending longitudinally along an internal surface of the sleeve below the rim;

(b) a support rim comprising a planar base to be rested on the upper edge of a manhole foundation and a cylindrical wall extending upwardly from the base, a portion of the base extending inwardly, beyond the inner surface of the wall for supporting the sleeve, the wall being of a diameter so as to co-operate with the sleeve and prevent relative lateral displacement thereof;

(c) an annular height adjustment ring to sit on and be supported by the inwardly extending annular portion of the base; and (d) riser blocks secured to and upwardly extending from the height adjustment ring, the riser blocks each having an upper surface with steps therein at a plurality of pre-determined elevations, the blocks and steps positioned so as to supportably receive the lower ends of corresponding ribs of the sleeve at the same one of said predetermined elevations, the cylindrical sleeve and the annular height adjustment ring each being relatively rotatable with respect to each other and with respect to the support base so as to permit alignment of the ribs and the steps and thus adjustment of the elevation of the manhole cover.

2. An adjustable manhole top according to claim 1 wherein the wall of the support rim circumscribes the sleeve when in position.

3. An adjustable manhole top according to claim 2 wherein the steps are in the form of notches and are located at progressively higher elevations with respect to the height adjustment ring across the upper surface of each of the riser blocks.

4. An adjustable manhole top according to claim 2 wherein a total of four spacer blocks are positioned on the height adjustment ring, the blocks spaced equally about the ring at 90° angles from each other.

5. An adjustable manhole top according to claim 4 wherein a total of four ribs are positioned on the inner wall of the sleeve, the ribs equally spaced on the inner surface of the sleeve at 90° angles from each other.

6. An adjustable manhole top according to claim 3 wherein the lower ends of the corresponding ribs are convexly curved and the notches of the steps are concavely curved so as to mateably receive the lower ends of the ribs.

7. An adjustable manhole top according to claim 1 wherein the height adjustment ring rests on a non-corrosive annular ring which in turn rests on the inwardly extending annular portion of the base.

8. An adjustable manhole top according to claim 1 further provided with a non-corrosive cylindrical liner to fit between the sleeve and the wall of the rim to facilitate adjustment of the sleeve.

9. An adjustable manhole top according to claim 2 wherein the elongated ribs of the cylindrical sleeve are equally spaced about the internal surface of the sleeve.

10. An adjustable manhole top according to claim 1 further provided with an annular retainer collar adapted to be snugly fitted about the upper end of the sleeve so that the upper edge of the sleeve and the upper edge of the collar are approximately flush, the retainer collar having an outwardly extending annular projection from its exterior surface, this projection to become embedded in a poured roadway surface about the manhole top, the roadway surface to be laid to the upper edge of the retainer collar.

* * * * *